US006460273B2

(12) United States Patent
Witjes

(10) Patent No.: US 6,460,273 B2
(45) **Date of Patent: *Oct. 8, 2002**

(54) COVERING SOLE

(75) Inventor: Eric Bernardus Wilhelmus Witjes, Ede (NL)

(73) Assignee: Concin SA, Luxembourg (LU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/254,839

(22) PCT Filed: Sep. 8, 1997

(86) PCT No.: PCT/NL97/00511

§ 371 (c)(1),
(2), (4) Date: Aug. 25, 1999

(87) PCT Pub. No.: WO98/10672

PCT Pub. Date: Mar. 19, 1998

(65) Prior Publication Data

US 2001/0047596 A1 Dec. 6, 2001

(30) Foreign Application Priority Data

Sep. 13, 1996 (NL) ..... 1004022
Oct. 1, 1996 (NL) ..... 1004156

(51) Int. Cl.[7] ..... A43C 13/00; A43C 15/00; A43B 23/28; A43B 19/00

(52) U.S. Cl. ..... 36/71.5; 36/71; 36/59 R; 36/59 C; 36/31; 36/15

(58) Field of Search ..... 12/142 Q; 36/59 R, 36/8.4, 43, 97, 29, 92, 71.5, 132, 136, 19.5, 31, 32 R, 35 A, 71, 59 A, 100, 101, 15, 44; 428/43, 41.7, 41.8, 42.2; 248/346.01, 346.11, 345.6, 345.1, 346.07

(56) References Cited

U.S. PATENT DOCUMENTS

| | | | | | |
|---|---|---|---|---|---|
| 546,932 | A | * | 9/1895 | Mayer | |
| 1,669,901 | A | * | 5/1928 | Hartwell | |
| 1,714,943 | A | * | 5/1929 | Brockman | |
| 3,143,812 | A | * | 8/1964 | Bittner | |
| 3,177,518 | A | * | 4/1965 | Bergstrom | 248/346.11 |
| 3,561,140 | A | * | 2/1971 | Ludwig | |
| 4,387,516 | A | * | 6/1983 | Laux | |
| 4,897,936 | A | * | 2/1990 | Fuerst | |
| 4,959,251 | A | * | 9/1990 | Owens et al. | 428/43 |
| 5,155,927 | A | * | 10/1992 | Bates et al. | |
| 5,264,218 | A | * | 11/1993 | Rogozinski | 428/43 |
| 5,413,637 | A | * | 5/1995 | Bastow | 428/43 |
| 5,669,161 | A | * | 9/1997 | Huang | |

* cited by examiner

*Primary Examiner*—Anthony D. Stashick
(74) *Attorney, Agent, or Firm*—Young & Thompson

(57) ABSTRACT

An outer sole for footware, having a rounded outer circumference and a plurality of concentric separate zones that are separated from one another by lanes which are incised into the sole. The lanes are incised from one side only and the side of the sole opposite that one side is covered with an adhesive layer for adhesion to the underside of footwear. The adhesive layer is covered by a protective foil adapted to be peeled off before the sole is applied to footwear.

3 Claims, 1 Drawing Sheet

COVERING SOLE

FIELD OF THE INVENTION

The invention relates to a covering sole for footwear, comprising a comparatively wear-resistant, disc-shaped body which has at least substantially the same shape as a walking surface of the footwear.

BACKGROUND OF THE INVENTION

Such a sole is mostly used when the original sole of the footwear has worn away. The covering sole is then attached to the footwear in some way and thus provides a renewed walking surface. It also happens that a walking surface of the footwear which has in fact not yet worn away completely, or is even unused, is covered with a covering sole so as to create a walking surface with different, more favourable walking properties. In particular, the comparatively smooth walking surface of a leather sole is thus replaced by the higher-friction walking surface of a synthetic resin covering sole.

Although the replacement or renewal of the soles of footwear is often left to a professional shoemaker, a considerable number of walkers prefer to do this themselves. Loose covering soles in various shoe sizes are commercially available for this purpose, which soles can be adhered to the existing soles of the footwear by means of a glue which may or may not be supplied along with the soles. Preferably, a covering sole is used for this which fits the shoe size of the footwear to be covered. Since the demand for covering soles of this kind can never be exactly foreseen, the supplier has to keep all existing shoe sizes in stock, which represents a considerable investment.

OBJECT OF THE INVENTION

The present invention has for its object to provide a covering sole of the kind mentioned in the opening paragraph which has a wider range of application, i.e. which is suitable for several shoe sizes, so that the stock mentioned above can be rationalized.

SUMMARY OF THE INVENTION

According to the invention, a covering sole of the kind mentioned in the opening paragraph is for this purpose characterized in that the body comprises a number of separate zones which are separated from one another by lanes which run at least partly at least substantially parallel to an outer circumference of the body, along which lanes the body has been intentionally weakened so as to render possible a manual separation of at least one zone lying farther to the outside from a zone lying inside the former zone.

With such a sole, the portion having the desired circumferential size can be simply separated from the surrounding zones along the provided weakened lane. This portion is subsequently adhered to the existing sole of the footwear, the remainder is discarded. The invention is based on the recognition that the provided weakened lane on the one hand renders possible a simple, manual separation of the individual zones, while on the other hand the strength and the walking surface of the covering sole, once adhered to the footwear, are not adversely affected thereby.

To facilitate the attachment of the covering sole according tot he invention, a special embodiment thereof is furthermore characterized in that the body comprises a walking surface at a first side and is provided with an adhesive layer for adhesion to the footwear at an opposite side. This means that the adhesive layer need not be provided by the user himself but is present already, and may consist, for example, of a glue layer which is thermally activated. In a preferred embodiment, however, the covering sole according tot he invention is characterized in that the adhesive layer comprises a self-adhesive layer which is shielded by a protective foil before use.

BRIEF DESCRIPTION OF THE DRAWINGS

The invention will now be explained in more detail with reference to an embodiment and an accompanying drawing, in which.

DETAILED DESCRIPTION OF THE INVENTION

The Figures are purely diagrammatic and not drawn true to scale. Some dimensions have been particularly exaggerated for greater clarity.

Figure 1:
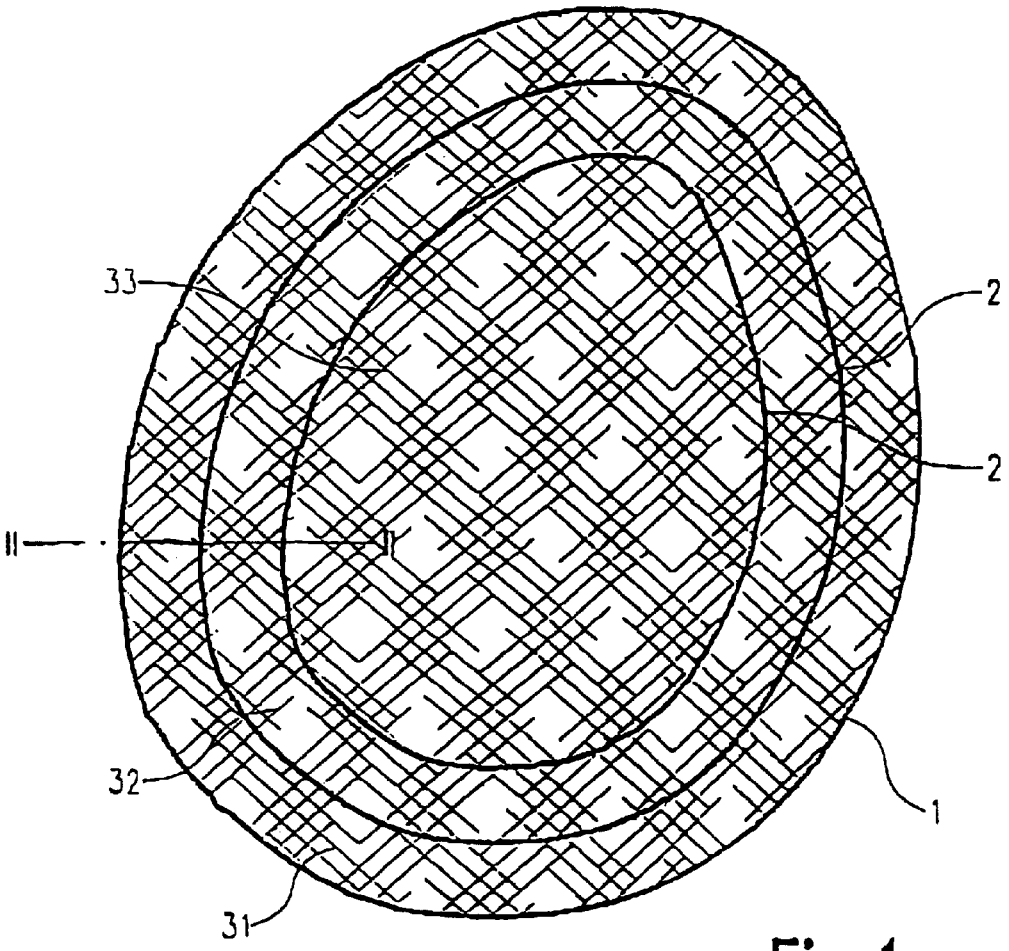
FIG. 1 is a plan view of an embodiment of a covering sole according tot he invention.

The covering sole in FIG. 1 comprises a comparatively wear-resistant disc-shaped body 1 of rubber, which may or may not be natural rubber, nylon, high-molecular polypropylene or polythene, teflon, or any other suitable material, and follows the circumference of the walking surface of an average walking shoe. If so desired, however, the shape of the body may be adapted to fit walking surfaces of different shapes belonging to less widely used shoe models. In general, the covering sole will have at least substantially the same shape as the walking surface of the footwear to be covered thereby.

Figure 2:
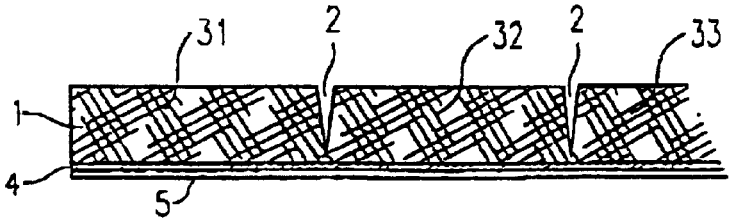
FIG. 2 is a cross-section taken on the line II—II in FIG. 1.

According to the invention, the covering sole comprises a number of separate zones 31,32,33 which are mutually separated by lanes 2 which in parallel to the outer circumference and in which the body 1 is provided with weakened portions. The weakening in this case consists of an incision shown in more detail and on an exaggerated scale in FIG. 2. Thanks to such a weakened portion, a specific zone 32,33 may be simply manually separated from the surrounding zone(s) so as to have the covering sole fit as well as possible the specific shoe size of the footwear to be covered. The zones may be pulled apart from one another, for example, along the weakened lane 2, or may be prised loose by means of a sharp object such as a knife or a pair of scissors. The continuous weakened portion also ensures that the contour of the covering sole is retained.

After the covering sole has thus been reduced to size, a protective foil 5 is pulled off a self-adhesive layer 4, whereupon the covering sole is stuck with its adhesive layer 4 against the existing, possibly worn sole of the footwear. The covering sole thus provides a renewed walking surface for the footwear. In this example, a suitable profile is provided in the side facing away from the adhesive layer 4, indicated diagrammatically by means of cross hatching. It is thus possible, for example, to cover a smooth original sole of the footwear, for example made of leather, with a covering sole according to the invention having a walking surface of higher friction, if so desired. Conversely, a rough, profiled sole may be replaced with a smooth walking surface in a similar manner, if so desired.

The invention thus provides a covering sole which not merely prolongs the life of existing footwear but also adapts the wearing comfort thereof to the specific wishes of the user.

Although the invention was explained in detail above with reference to only a single embodiment, it will be obvious to all that the invention is by no means limited to the example given. On the contrary, many variations, implementations and designs are possible to the average skilled person without departing from the scope of the invention. Thus it is possible to replace the self-adhesive layer used in the example with an alternative adhesive layer, or to dispense with an adhesive layer altogether. In the latter case, the adhesive layer is to be provided later, or the covering sole may be attached to the existing sole by means of stitching equipment specially designed for the purpose, although this will usually only be performed by a professional shoemaker and is less suitable for do it yourself applications.

Instead of substantially annular, closed lanes along which the body is intentionally weakened, as in the embodiment described, it is alternatively possible for the weakened portions to follow a different pattern of lanes which may or may not be closed such as, for example, a system of parabolas of different sizes which lie one inside the other. The weakened portion may also continue so far that a complete separation of the individual lanes is already achieved thereby. The zones may nevertheless form a coherent unit in that case, for example in that they are held together by an adhesive layer, or may be loosely packed together.

It should also be noted for completeness' sake here that the term "footwear" refers not only to shoes within the scope of the invention, but also, for example, to (Wellington) boots, slippers, clogs, and other kinds of objects usually worn on the feet. In addition, the invention is not limited to soles in the strict sense of the word but may be applied to heels of footwear in exactly the same way.

What is claimed is:

1. An outer sole for footwear, having a rounded outer circumference and a plurality of concentric separate zones that are separated from one another by lanes which are incised into the sole at least most of the thickness of the sole, thereby to render said zones readily separable from each other.

2. An outer sole as claimed in claim 1, wherein said lanes are incised from one side only and the side of said sole opposite said one side is covered with an adhesive layer.

3. An outer sole as claimed in claim 2, wherein said adhesive layer is covered by a protective foil adapted to be peeled off before the sole is applied to footwear.

* * * * *